US010926386B2

(12) United States Patent
Oishi et al.

(10) Patent No.: US 10,926,386 B2
(45) Date of Patent: Feb. 23, 2021

(54) IMPACT ROTARY TOOL

(71) Applicant: Panasonic Intellectual Property Management Co., Ltd., Osaka (JP)

(72) Inventors: Ryohei Oishi, Mie (JP); Hiroshi Miyazaki, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 294 days.

(21) Appl. No.: 15/417,928

(22) Filed: Jan. 27, 2017

(65) Prior Publication Data

US 2017/0217001 A1 Aug. 3, 2017

(30) Foreign Application Priority Data

Jan. 29, 2016 (JP) ..... JP2016-016381

(51) Int. Cl.
*B25B 23/147* (2006.01)
*B25B 21/02* (2006.01)

(52) U.S. Cl.
CPC ..... *B25B 23/1475* (2013.01); *B25B 21/02* (2013.01)

(58) Field of Classification Search
CPC ... B25B 23/1475; B25B 21/02; B25B 21/026; B25B 21/00; B25B 23/1405; B25B 23/14; B25B 23/1453; B25B 23/147; G01L 27/007
USPC ..... 173/112; 702/116
See application file for complete search history.

(56) References Cited

U.S. PATENT DOCUMENTS 4,478,290 A * 10/1984 Orthwein ..... E21D 20/003 173/11
5,277,261 A * 1/1994 Sakoh ..... B25B 21/02 173/109
5,289,885 A * 3/1994 Sakoh ..... B25B 23/1405 173/109
7,890,283 B2 * 2/2011 Sadayuki ..... G01D 3/08 324/500
8,397,967 B2 * 3/2013 Calvet ..... B25C 1/04 227/2
8,607,892 B2 * 12/2013 Iimura ..... B25B 21/02 173/181
8,678,106 B2 * 3/2014 Matsunaga ..... B25B 21/008 173/176
9,579,776 B2 * 2/2017 Arimura ..... B25B 21/02
(Continued)

FOREIGN PATENT DOCUMENTS

JP 2005-118910 A 5/2005
JP 2009-083038 A 4/2009
JP 2009-172741 A 8/2009

*Primary Examiner* — Dariush Seif
(74) *Attorney, Agent, or Firm* — McDermott Will & Emery LLP

(57) ABSTRACT

An impact rotary tool includes: an impact mechanism that applies stroke impact to an output shaft by an output from a motor; a stroke detector that detects a stroke by the impact mechanism; a controller that stops rotation of the motor based on the detection result by the stroke detector; and a voltage detector that detects a voltage in the stroke detector. The controller determines whether the stroke detector has an abnormality based on the voltage detected by the voltage detector while the motor is not rotating. An informing unit informs a user that an abnormality is occurring when the controller determines an abnormality in the stroke detector.

4 Claims, 5 Drawing Sheets

(56) References Cited

U.S. PATENT DOCUMENTS 9,654,044 B2 * 5/2017 Miyazaki ..... H02P 25/032
9,687,972 B2 * 6/2017 Sekino ..... B25B 21/02
2002/0050364 A1 * 5/2002 Suzuki ..... B25B 21/02 173/1
2004/0193988 A1 * 9/2004 Saloio ..... G01D 3/08 714/742
2006/0185869 A1 * 8/2006 Arimura ..... B25B 23/1475 173/176
2009/0000801 A1 * 1/2009 Calvet ..... B25C 1/04 173/210
2009/0177429 A1 * 7/2009 Itoi ..... G06F 3/05 702/116
2009/0308624 A1 * 12/2009 Shibata ..... B25B 23/1405 173/1
2011/0073334 A1 * 3/2011 Iimura ..... B25B 21/02 173/2
2011/0203822 A1 * 8/2011 Harada ..... B25B 21/02 173/20
2012/0073846 A1 * 3/2012 Hirai ..... B25B 21/02 173/200
2012/0199372 A1 * 8/2012 Nishikawa ..... B25B 23/1475 173/132
2012/0279736 A1 * 11/2012 Tanimoto ..... B25B 23/1475 173/2
2012/0292065 A1 * 11/2012 Hoshi ..... B25B 21/02 173/93
2012/0318550 A1 * 12/2012 Tanimoto ..... B25B 23/1475 173/117
2013/0008679 A1 * 1/2013 Nishikawa ..... B25B 21/02 173/93
2013/0014967 A1 * 1/2013 Ito ..... B25F 5/021 173/93
2013/0025892 A1 * 1/2013 Mashiko ..... B25B 21/02 173/2
2013/0062086 A1 * 3/2013 Ito ..... B25B 23/1405 173/1
2013/0062088 A1 * 3/2013 Mashiko ..... B25B 21/02 173/2
2013/0075121 A1 * 3/2013 Nakamura ..... B25B 21/026 173/94
2013/0087355 A1 * 4/2013 Oomori ..... B25B 21/026 173/47
2013/0126202 A1 * 5/2013 Oomori ..... B25B 21/00 173/217
2013/0186666 A1 * 7/2013 Yoshino ..... B25B 23/1475 173/176
2013/0199809 A1 * 8/2013 Zeller ..... B25B 23/14 173/1
2013/0333910 A1 * 12/2013 Tanimoto ..... B25B 21/026 173/176
2013/0341058 A1 * 12/2013 Roehm ..... B25F 5/00 173/178
2014/0102741 A1 * 4/2014 Sekino ..... B25B 21/02 173/181
2014/0262390 A1 * 9/2014 Arimura ..... B25B 21/02 173/7
2015/0054428 A1 * 2/2015 Osborne ..... H01M 10/4264 318/139
2015/0196987 A1 * 7/2015 Hayashi ..... B23Q 17/2404 173/46
2015/0231770 A1 * 8/2015 Kusakawa ..... B25B 23/1475 173/93.5
2016/0121467 A1 * 5/2016 Ng ..... B25B 21/026 173/176
2016/0190965 A1 * 6/2016 Miyazaki ..... H02P 25/032 318/14
2017/0008156 A1 * 1/2017 Miyazaki ..... B25B 23/1475
2017/0144278 A1 * 5/2017 Nishikawa ..... B25B 21/026

* cited by examiner

IMPACT ROTARY TOOL

This application is based upon and claims the benefit of priority of the Japanese Patent Application No. 2016-16381, filed on Jan. 29, 2016, the entire contents of which are incorporated herein by reference.

BACKGROUND

1. Field of the Invention

The present disclosure relates to impact rotary tools such as impact wrenches and impact drivers.

2. Description of the Related Art

Impact rotary tools fasten screws or the like such as a bolt or a nut by applying stroke impact in a rotation direction to an output shaft (anvil) by a hammer rotated by an output from a motor. In the related art, an impact rotary tool having a shut-off function to stop a motor when fastening torque reaches a value having been set in advance is provided. In order to enhance an accuracy of torque of the shut-off function, it is preferable to provide a torque measurement means to an output shaft and to directly measure actual fastening torque. However, this disadvantageously results in higher cost and larger size of the tool. Therefore, methods of managing torque as described in Japanese Unexamined Patent Application Publication No. 2005-118910 and Japanese Unexamined Patent Application Publication No. 2009-83038 are proposed.

Japanese Unexamined Patent Application Publication No. 2005-118910 discloses an impact rotary tool that detects a rotation angle of an output shaft from detection of a previous stroke to detection of a following stroke by a stroke detecting means, calculates fastening torque by dividing, by the rotation angle of the output shaft between the strokes, stroke energy calculated from average rotation speed of a driving shaft between the strokes, and automatically stops a motor when the calculated fastening torque is more than or equal to a torque value having been set in advance by a setting means of fastening torque.

Japanese Unexamined Patent Application Publication No. 2009-83038 discloses an impact rotary tool that automatically stops a motor when the number of strokes detected by a stroke detecting means reaches a predetermined number of strokes. This impact rotary tool corrects the predetermined number of strokes to prevent shortage of fastening torque when blowing speed, calculated from a blowing timing and a motor rotation angle, is less than or equal to predetermined blowing speed.

A premise in the impact rotary tools disclosed in Japanese Unexamined Patent Application Publication No. 2005-118910 and Japanese Unexamined Patent Application Publication No. 2009-83038 is that a stroke by a hammer is detected by a stroke detecting means in order to implement the shut-off function. For effective detection of a stroke, the stroke detecting means is required to be disposed near the hammer, however, this may disadvantageously cause a failure such as disconnection of lead wire connected to the stroke detecting means due to impact.

Japanese Unexamined Patent Application Publication No. 2009-172741 discloses an impact rotary tool that stops a motor when fastening torque estimated from an output from a stroke detector reaches a torque value having been set in advance. This impact rotary tool includes a current detecting part that detects a motor current and a determining part that determines an abnormality in the stroke detector from the motor current detected by the current detecting part and an output from the stroke detector. In this impact rotary tool, an abnormality in the stroke detector is determined when no stroke is detected in the stroke detector while determination is made from the motor current that there is a stroke.

According to the technique disclosed in Japanese Unexamined Patent Application Publication No. 2009-172741, an abnormality in the stroke detector is determined after the motor is driven by operation by a user and thus there is a disadvantage that torque management is not performed on a screw or the like fastened by driving of the motor.

SUMMARY OF THE INVENTION

One aspect of the present invention has been devised in consideration to such circumstances. An object of one aspect of the present invention is to provide technique for determining an abnormality in a stroke detector while a motor is not driven.

In order to solve the above problem, an impact rotary tool of one aspect of the present invention includes: an impact mechanism that applies stroke impact to an output shaft by an output from a motor; a stroke detector that detects a stroke by the impact mechanism; and a controller that stops rotation of the motor based on the detection result by the stroke detector.

The impact rotary tool further includes a voltage detector that detects a voltage in the stroke detector. The controller determines whether the stroke detector has an abnormality based on the voltage detected by the voltage detector while the motor is not rotating.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

One aspect of the invention will now be described by reference to the preferred embodiments. This does not intend to limit the scope of the present invention, but to exemplify the invention.

Figure 1:
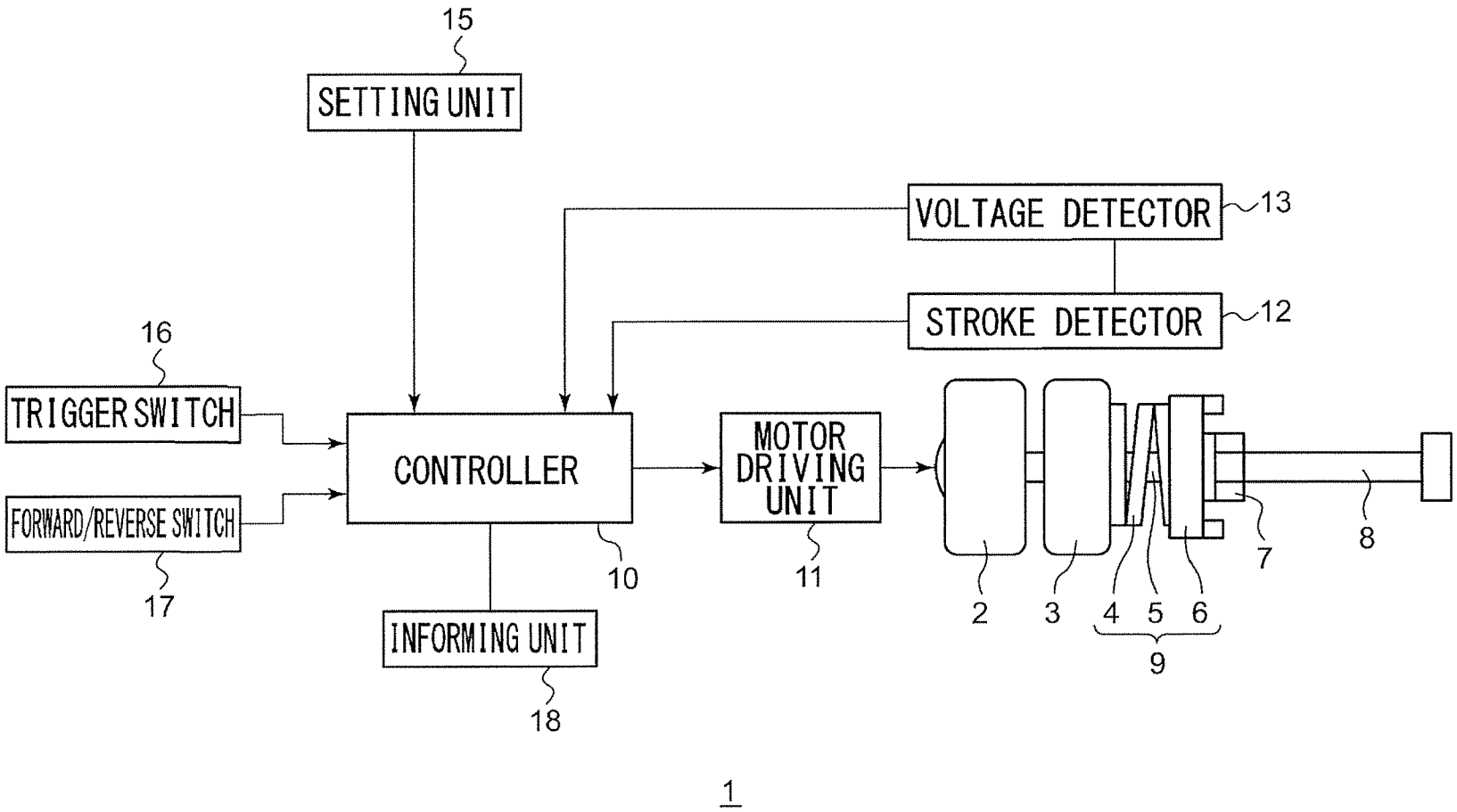
FIG. 1 is a diagram illustrating a configuration of an impact rotary tool according to an embodiment.

FIG. 1 is a diagram illustrating a configuration of an impact rotary tool according to an embodiment of the present invention. In an impact rotary tool 1, power is supplied from a charging battery (not illustrated). A motor 2 which is a driving source is driven by a motor driving unit 11. Rotational output of the motor 2 is decelerated by a speed reducer 3 and thereby transferred to a driving shaft 5. The driving shaft 5 is connected with a hammer 6 via a cam mechanism (not illustrated). The hammer 6 is energized by a spring 4 toward an anvil 7 provided with an output shaft 8 and the hammer 6 is thereby engaged with the anvil 7.

When force of more than or equal to a predetermined value does not act between the hammer 6 and the anvil 7, the hammer 6 and the anvil 7 are maintained in an engaged state where the hammer 6 transfers rotation of the driving shaft 5 to the anvil 7 as it is. When force of more than or equal to a predetermined value acts between the hammer 6 and the anvil 7, however, the hammer 6 recedes against the spring 4 and the engaged state of the hammer 6 and the anvil 7 is canceled. Thereafter, by being energized by the spring 4 and guided by the cam mechanism, the hammer 6 advances while rotating and applies stroke impact (impact) to the anvil 7 in a rotation direction. In the impact rotary tool 1, the spring 4, the driving shaft 5, and the hammer 6 form an impact mechanism 9 that applies stroke impact to the anvil 7 and the output shaft 8 by an output from the motor.

A controller 10 is formed by a microcomputer or the like mounted on a control substrate and controls rotation of the motor 2. A trigger switch 16 is an operation switch operated by a user. The controller 10 controls on/off of the motor 2 based on operation of the trigger switch 16 and supplies a driving command to the motor driving unit 11 corresponding to an operation amount of the trigger switch 16. The motor driving unit 11 adjust a voltage applied to the motor 2 by the driving command supplied from the controller 10 and thereby adjusts the number of revolutions of the motor.

A forward/reverse switch 17 is a switch for switching between forward rotation (rotation in a forward direction) and reverse rotation (rotation in a reverse direction) of the motor 2. When a screw or the like such as a bolt or a nut is fastened, a user moves the forward/reverse switch 17 to the forward rotation side and then operates the trigger switch 16. When a screw or the like is loosened, the user moves the forward/reverse switch 17 to the reverse rotation side and then operates the trigger switch 16.

The impact rotary tool 1 of the embodiment has two operation modes that the user can select. In a first operation mode, rotation of the motor 2 is stopped based on a detection result by the stroke detector 12 and a shut-off function, for automatically stopping the motor 2 when fastening torque reaches a torque value having been set by the user, is active. When selecting the first operation mode, the user sets a desired fastening torque value and then uses the impact rotary tool 1. Unlike in the first operation mode, in a second operation mode the shut-off function is inactive. In the second operation mode, rotation of the motor 2 is not automatically stopped and thus the user adjusts an operation amount of the trigger switch 16 and thereby prevents excessively fastening of the screw or the like.

A setting unit 15 sets either one of the first operation mode and the second operation mode based on selection operation by the user. When selecting the first operation mode, the user sets also a setting torque value. The controller 10 controls rotation of the motor 2 according to the operation mode set by the setting unit 15.

The stroke detector 12 detects a stroke by the impact mechanism 9. The stroke detector 12 includes at least an impact sensor that detects impact of a stroke by the hammer 6 on the anvil 7 and an amplifier that amplifies an output from the impact sensor. An exemplary impact sensor is a piezoelectric shock sensor and outputs a voltage signal corresponding to impact. The amplifier amplifies the output voltage signal within a predetermined range of voltage and thereby supplies the voltage signal to the controller 10.

Figure 2:
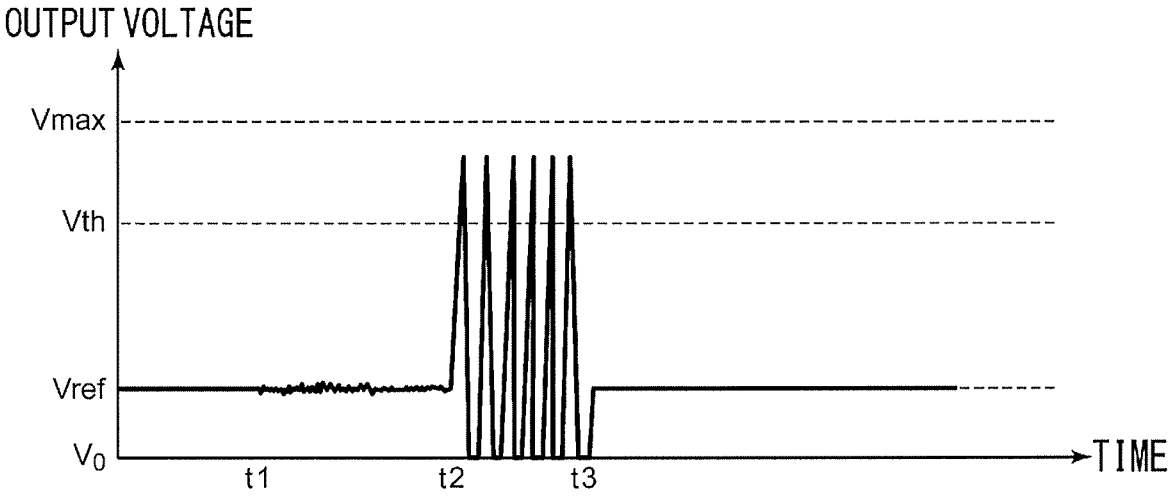
FIG. 2 is a diagram illustrating an exemplary output voltage waveform of a stroke detector in a first operation mode.

FIG. 2 is a diagram illustrating an exemplary output voltage waveform of the stroke detector 12 in the first operation mode. The output voltage waveform represents a detection result by the stroke detector 12 when the user fastens the screw or the like. The stroke detector 12 outputs a voltage value corresponding to impact within a range between a lower limit voltage Vo and an upper limit voltage Vmax. For example, a lower limit voltage Vo is 0 V and an upper limit voltage Vmax is 5 V.

The stroke detector 12 is applied with an offset voltage over the lower limit voltage Vo to allow detection of impact in the positive direction and the negative direction. This offset voltage serves as a reference voltage Vref for an output from the stroke detector 12. The stroke detector 12 outputs a voltage value corresponding to impact with the reference voltage Vref in the center. An exemplary reference voltage Vref is 1 V.

In the output voltage waveform illustrated in FIG. 2, a user starts operation of the trigger switch 16 at time t1 and the controller 10 supplies a driving command corresponding to an operation amount of the trigger switch 16 to the motor driving unit 11. The motor driving unit 11 then rotates the motor 2 according to the driving command. During a period from time t1 to time t2, the hammer 6 and the anvil 7 are maintained in the engaged state and thereby integrally rotate. At time t2, strokes by the impact mechanism 9 including the hammer 6 start. When an output voltage from the stroke detector 12 exceeds a stroke determination voltage Vth, the controller 10 determines that a stroke by the impact mechanism 9 has occurred. The controller 10 may include a comparator that compares the output voltage from the stroke detector 12 to the stroke determination voltage Vth and determine occurrence of a stroke from the output from the comparator. An exemplary stroke determination voltage Vth is 3.5 V.

When the setting unit 15 has set the first operation mode, the controller 10 executes motor control to automatically stop rotation of the motor 2 when the number of strokes detected by the stroke detector 12 reaches the number of strokes corresponding to the setting torque value. The controller 10 stops rotation of the motor 2 when the number of strokes counted from time t2 reaches the number of strokes corresponding to the setting torque value. In FIG. 2, the controller 10 stops rotation of the motor 2 at time t3.

In this manner the controller 10 stops rotation of the motor 2 based on the detection result by the stroke detector 12 and thus, in order to execute this motor control, it is required that the stroke detector 12 operates normally. Therefore the stroke detector 12 is disposed in the vicinity of the impact mechanism 9 in order to effectively detect a stroke by the impact mechanism 9 while the control substrate mounted with the controller 10 is disposed in a lower end portion of a housing or another place where a space for installment can be ensured. This means that the stroke detector 12 and the controller 10 are connected by lead wire or the like; however, disconnection may occur due to the impact by the impact mechanism 9.

Figure 3:
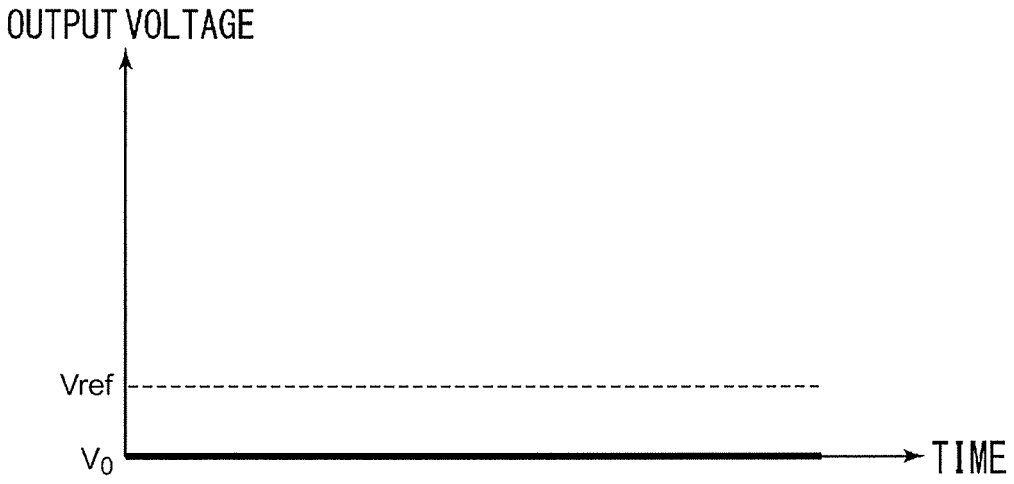
FIG. 3 is a diagram illustrating an exemplary output voltage upon occurrence of an abnormality in the stroke detector.

FIG. 3 is a diagram illustrating an exemplary output voltage upon occurrence of an abnormality in the stroke detector 12. For example when power source supply wire or signal output wire is disconnected, a voltage output from the stroke detector 12 to the controller 10 is Vo (0 V).

Figure 4:
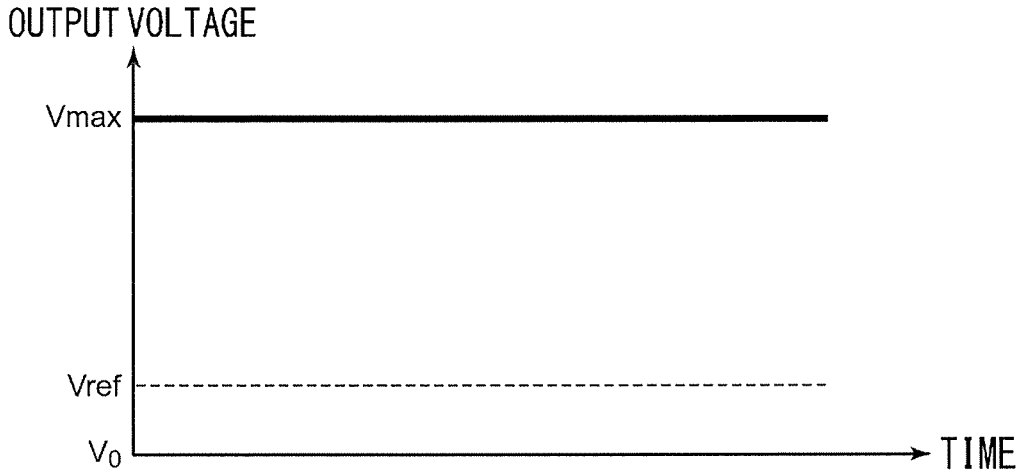
FIG. 4 is a diagram illustrating another exemplary output voltage upon occurrence of an abnormality in the stroke detector.

FIG. 4 is a diagram illustrating another exemplary output voltage upon occurrence of an abnormality in the stroke detector 12. For example when ground wire is disconnected, a voltage output from the stroke detector 12 to the controller 10 is Vmax (5 V).

Referring back to FIG. 1, the voltage detector 13 detects the output voltage from the stroke detector 12 and supplies the detected value to the controller 10. The controller 10 determines whether the stroke detector 12 has an abnormality based on the voltage detected by the voltage detector 13 while the motor 2 is not rotating.

When there is no disconnection in the lead wire and the stroke detector 12 operates normally, an output voltage from the stroke detector 12, while the motor 2 is not driven, represents the reference voltage Vref as illustrated by the voltage waveform in FIG. 2 before time t1 and after time t3. Note that the voltage waveform before time t1 represents a waveform before the user operates the trigger switch 16 (before the motor 2 rotates) and the voltage waveform after time t3 represents a waveform after the controller 10 has automatically stopped the motor 2 by the shut-off function. However when there is disconnection in the lead wire, an output voltage from the stroke detector 12 while the motor 2 is not driven represents an abnormal value of one of the lower limit voltage Vo and the upper limit voltage Vmax as illustrated in FIG. 3 and FIG. 4.

Figure 5:
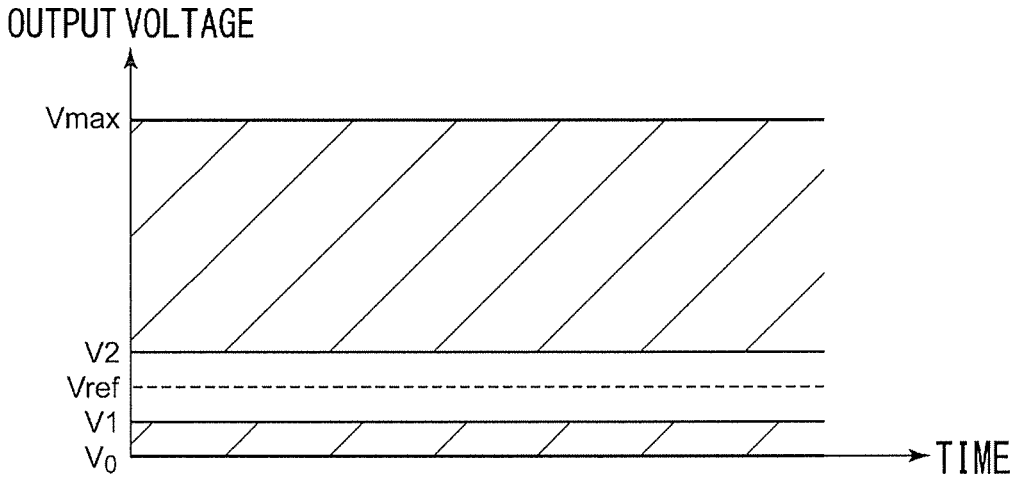
FIG. 5 is an explanatory diagram of voltage values in abnormality determination processing.

FIG. 5 is an explanatory diagram of voltage values in abnormality determination processing. The controller 10 determines that the stroke detector 12 is normally operating when the voltage detected by the voltage detector 13 while the motor 2 is not rotating is within the range of voltage V1 to voltage V2. Note that magnitude correlation among the voltage values illustrated in FIG. 5 is Vo<V1<Vref<V2<Vmax. The voltages V1 and V2 are set to cover amplitude of fluctuations of the reference voltage Vref applied to the stroke detector 12. For example the voltage V1 may be set 0.7 V lower than the reference voltage Vref and the voltage V2 may be set 0.7 V higher than the reference voltage Vref.

The controller 10 determines that the stroke detector 12 has an abnormality when the voltage detected by the voltage detector 13 while the motor 2 is not rotating is smaller than the voltage V1 or larger than the voltage V2. Note that the controller 10 may determine an abnormality in the stroke detector 12 when a period during which a voltage detected by the voltage detector 13 is smaller than the voltage V1 lasts for more than or equal to a predetermined period of time or when a period during which a voltage detected by the voltage detector 13 is larger than the voltage V2 lasts for more than or equal to a predetermined period of time. For example, this predetermined period of time is set to several seconds. In this manner, determining, by the controller 10, an abnormality in the stroke detector 12 under a condition that a voltage detected by the voltage detector 13 continuously represents an abnormal value while the motor 2 is not driven allows for absorbing fluctuations of an output voltage from the stroke detector 12 and performing accurate abnormality determination processing.

The controller 10 prohibits forward rotation of the motor 2 in the first operation mode when determining an abnormality in the stroke detector 12. Since the shut-off function cannot be performed unless the stroke detector 12 can detect a stroke by the impact mechanism 9, the controller 10 prohibits forward rotation of the motor 2 in the first operation mode. As a result of this, even if the user selects the first operation mode and operates the trigger switch 16, the controller 10 does not rotate the motor 2 forward. In the embodiment, the abnormality determination processing by the controller 10 is performed while the motor 2 is not driven, forward rotation of the motor 2 can be prohibited before rotating the motor 2 forward in the first operation mode.

Note that when the controller 10 determines an abnormality in the stroke detector 12, an informing unit 18 informs the user that an abnormality is occurring. The informing unit 18 may output alarm sound from a speaker for example or may output, from a display unit, an error code showing an abnormality in the stroke detector 12. If the impact rotary tool 1 has a display such as a liquid crystal panel, the informing unit 18 may display on the display that the first operation mode is not available due to a failure in the stroke detector 12. Informing of an abnormality by the informing unit 18 allows the user to be aware of unavailability of the first operation mode.

Note that when the setting unit 15 has set the first operation mode, the controller 10 prohibits forward rotation of the motor 2 but does not prohibit reverse rotation of the motor 2. For example when the impact rotary tool 1 is used in the first operation mode, there are cases where the controller 10 determines an abnormality in the stroke detector 12 after the motor 2 stops. In this case, the controller 10 prohibits forward rotation of the motor 2 while allowing reverse rotation, thereby allowing the user to switch the forward/reverse switch 17 to the reverse rotation side and to loosen the fastened screw or the like. Since the shut-off function is not performed upon reverse rotation of the motor 2 even when the first operation mode is set, it is preferable that the controller 10 does not prohibit reverse rotation of the motor 2 even when an abnormality is occurring in the stroke detector 12.

Note that, when the setting unit 15 has set the second operation mode, the controller 10 may perform the motor control in the second operation mode when determining an abnormality in the stroke detector 12. In the second operation mode, the controller 10 does not perform the motor control based on the detection result by the stroke detector 12 and thus the motor control in the second operation mode may be performed even when an abnormality is occurring in the stroke detector 12.

In this case, the informing unit 18 may display, on a display, a message showing that the second operation mode should be selected due to unavailability of the first operation mode. When the controller 10 determines an abnormality in the stroke detector 12, forward rotation of the motor 2 in the first operation mode is prohibited and thus the motor 2 is not driven even if the user operates the trigger switch 16. Therefore informing of necessity of switching to the second operation mode by the informing unit 18 allows the user to select the second operation mode and to perform fastening operation in the second operation mode.

An overview of an embodiment of the present invention is as follows.

An impact rotary tool (1) of an embodiment of the present invention includes: an impact mechanism (9) that applies stroke impact to an output shaft (8) by an output from a motor (2); a stroke detector (12) that detects a stroke by the impact mechanism (9); a controller (10) that stops the motor (2) from rotating based on the detection result by the stroke detector (12); and a voltage detector (13) that detects a voltage in the stroke detector (12). The controller (10) determines whether the stroke detector (12) has an abnormality based on the voltage detected by the voltage detector (13) while the motor (2) is not rotating.

The impact rotary tool (1) preferably further includes an informing unit (18) that informs a user that an abnormality is occurring when the controller (10) determines an abnormality in the stroke detector (12).

The impact rotary tool (1) may further include a setting unit (15) that sets, based on selection operation by the user, one of a first operation mode in which rotation of the motor (2) is stopped based on the detection result by the stroke detector (12) and a second operation mode different from the first operation mode. The controller (10) may prohibit forward rotation of the motor (2) in the first operation mode when determining an abnormality in the stroke detector (12).

When the setting unit (15) has set the first operation mode, the controller (10) preferably prohibits forward rotation of the motor (2) but does not prohibit reverse rotation of the motor (2).

When the setting unit (15) has set the second operation mode when the controller (10) determines an abnormality in the stroke detector (12), the controller (10) may perform motor control in the second operation mode.

One aspect of the present invention has been described above based on the embodiments. These embodiments are merely examples. Therefore, it should be understood by a person skilled in the art that combinations of the components or processing processes of the examples may include various variations and that such a variation is also within the scope of the present invention.

In the embodiments, the controller 10 executes motor control to automatically stop rotation of the motor 2 in the first operation mode when the number of strokes detected by the stroke detector 12 reaches the number of strokes corresponding to the setting torque value. In a variation, a controller 10 may estimate fastening torque based on a detection result by a stroke detector 12 and execute motor control to automatically stop rotation of a motor 2 when the estimated fastening torque reaches the setting torque value.

The informing unit 18 informs the user of abnormality occurrence when the controller 10 determines an abnormality in the stroke detector 12; however, the controller 10 may cause a nonvolatile memory to retain the result of abnormality determination. The controller 10 performs abnormality determination processing on the stroke detector 12 before initiating next operation. Even if the stroke detector 12 is determined as being normal, the informing unit 18 may inform the user that an abnormality has occurred in the previous processing when the nonvolatile memory stores that the abnormality has been determined in the previous abnormality determination processing.

While the foregoing has described what are considered to be the best mode and/or other examples, it is understood that various modifications may be made therein and that the subject matter disclosed herein may be implemented in various forms and examples, and that they may be applied innumerous applications, only some of which have been described herein. It is intended by the following claims to claim any and all modifications and variations that fall within the true scope of the present teachings.

What is claimed is:

1. An impact rotary tool, comprising:

an impact mechanism that applies stroke impact to an output shaft by an output from a motor;

a stroke detector that detects a stroke by the impact mechanism and outputs an output voltage which is applied with an offset voltage Vref which is offset from and larger than a lower limit voltage Vo; and a controller that stops rotation of the motor based on the detection result by the stroke detector; and a setting unit that sets, based on selection operation by a user, one of a first operation mode in which rotation of the motor is stopped based on the detection result by the stroke detector and a second operation mode different from the first operation mode, wherein the impact rotary tool further comprises a voltage detector that detects the output voltage of the stroke detector, the controller determines that the stroke detector has an abnormality when a period during which the output voltage detected by the voltage detector while the motor is not rotating is smaller than a voltage V1 lasts for more than or equal to a predetermined period of time or when a period during which the output voltage detected by the voltage detector while the motor is not rotating is larger than a voltage V2 lasts for more than or equal to a predetermined period of time, where the voltage V1 is larger than the lower limit voltage Vo and lower than the offset voltage Vref, and the voltage V2 is larger than the offset voltage Vref and lower than an upper limit voltage Vmax, when the controller determines that the stroke detector has the abnormality and when the setting unit has set the first operation mode, the controller prohibits forward rotation of the motor but does not prohibit reverse rotation of the motor.

2. The impact rotary tool according to claim 1, further comprising:

an informing unit that informs a user that an abnormality is occurring when the controller determines an abnormality in the stroke detector.

3. The impact rotary tool according to claim 1, wherein the controller performs motor control in the second operation mode when determining an abnormality in the stroke detector when the setting unit has set the second operation mode.

4. The impact rotary tool according to claim 1, wherein:

in the first operation mode, the rotation of the motor is automatically stopped when fastening torque reaches a torque value set by the user, and in the second operation mode, rotation of the motor is not automatically stopped.

* * * * *